US007476007B1

(12) United States Patent
Lin et al.

(10) Patent No.: US 7,476,007 B1
(45) Date of Patent: Jan. 13, 2009

(54) LIGHT SOURCE LENS

(75) Inventors: Chung Yiu Lin, Taipei (TW); Yung Tai Chen, Keelung (TW)

(73) Assignee: Optron Optoelectronic Corp., Taipei County (TW)

( * ) Notice: Subject to any disclaimer, the term of this patent is extended or adjusted under 35 U.S.C. 154(b) by 0 days.

(21) Appl. No.: 12/007,400

(22) Filed: Jan. 10, 2008

(51) Int. Cl.
*F21V 3/00* (2006.01)

(52) U.S. Cl. ..... 362/311; 362/326; 362/338; 362/800

(58) Field of Classification Search ..... 362/311, 362/326, 332, 338, 361, 800
See application file for complete search history.

(56) References Cited

U.S. PATENT DOCUMENTS 5,251,118 A * 10/1993 Budnovitch et al. ..... 362/362
6,019,493 A * 2/2000 Kuo et al. ..... 362/335
7,021,797 B2 * 4/2006 Miñano et al. ..... 362/355
7,121,691 B2 * 10/2006 Coushaine et al. ..... 362/298
7,413,325 B2 * 8/2008 Chen ..... 362/249

* cited by examiner

*Primary Examiner*—Ali Alavi
(74) *Attorney, Agent, or Firm*—Rosenberg, Klein & Lee

(57) ABSTRACT

A light source lens includes a circular lens mount defining a shallow concave recess with a square opening, and a lens engaged with the lens mount to locate above the concave recess to receive light projected thereto via the square opening. The lens includes a first spherical portion and a second spherical portion protruded from a top center of the first spherical portion, and is densely provided at a bottom with a plurality of irregular grooves to form an uneven bottom surface. The first and the second spherical portion diffuses and concentrates, respectively, a light source passed through the lens, and the uneven bottom surface of the lens causes the light passed therethrough to scatter at more different angles, so that any halo is eliminated and a softer lighting effect is created.

2 Claims, 5 Drawing Sheets

LIGHT SOURCE LENS

FIELD OF THE INVENTION

The present invention relates to a light source lens, and more particularly to a light source lens that concentrates a light source while creating a softer lighting effect.

BACKGROUND OF THE INVENTION

For the light source from a light-emitting diode (LED) to be well diffused, a general LED lamp usually includes a lens disposed in front of the LED, so that the light source from the LED is projected through and refracted by the lens to form an illuminated area at a desired location. A conventional lens for this purpose has only one concave surface. Therefore, the light source passed through the lens is diffused at a uniform angle, and a significant halo is formed around the illuminated area. The light source passed through the conventional lens is not soft enough to thereby easily cause sore eyes when a user works under the LED lamp over a long time. The sharp light also tends to result in poor sight. It is therefore tried by the inventor to develop an improved light source lens that may be applied on an LED lamp to concentrate the light source while creating a softer lighting effect, so as to eliminate the above-mentioned disadvantages.

SUMMARY OF THE INVENTION

A primary object of the present invention is to provide a light source lens that may be applied on an LED lamp to eliminate the halo formed around an illuminated area, and concentrate the light source while creating a softer lighting effect to avoid sore eyes and poor sight.

To achieve the above and other objects, the light source lens according to the present invention includes a circular lens mount and a lens. The circular lens mount is provided along an outer periphery with an upright flange having a predetermined height to define a shallow concave recess on the annular lens mount. A top surface of the shallow concave recess is reflectorized, and a square opening is formed at a center of the shallow concave recess to allow a light source to project therethrough. The lens is engaged with the lens mount to locate above the shallow concave recess to receive the light source projected thereto via the square opening, and includes a first spherical portion and a second spherical portion slightly raised from a top center of the first spherical portion, so that the first and the second spherical portion diffuses and concentrates, respectively, the light source passed through the lens to eliminate any halo from an illuminated area.

In the present invention, the lens is densely provided at a bottom with a plurality of irregular grooves to form an uneven bottom surface. The uneven bottom surface of the lens causes the light source passed therethrough to scatter at more different angles, so that a softer lighting effect is created.

In the present invention, the lens is provided around a bottom periphery with a radially extended flange for firmly engaging with an inner side of the upright flange on the lens mount to thereby locate above the shallow concave recess.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
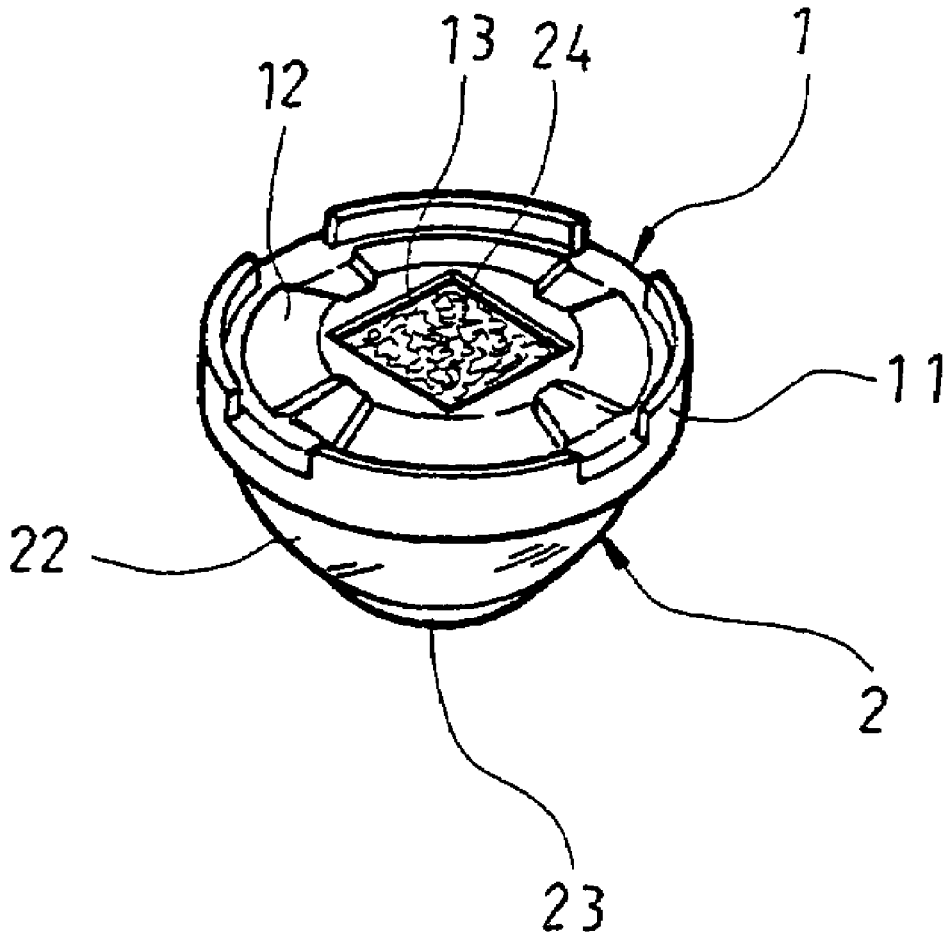
FIG. 1 is an assembled bottom perspective view of a light source lens according to a preferred embodiment of the present invention.
Figure 2:
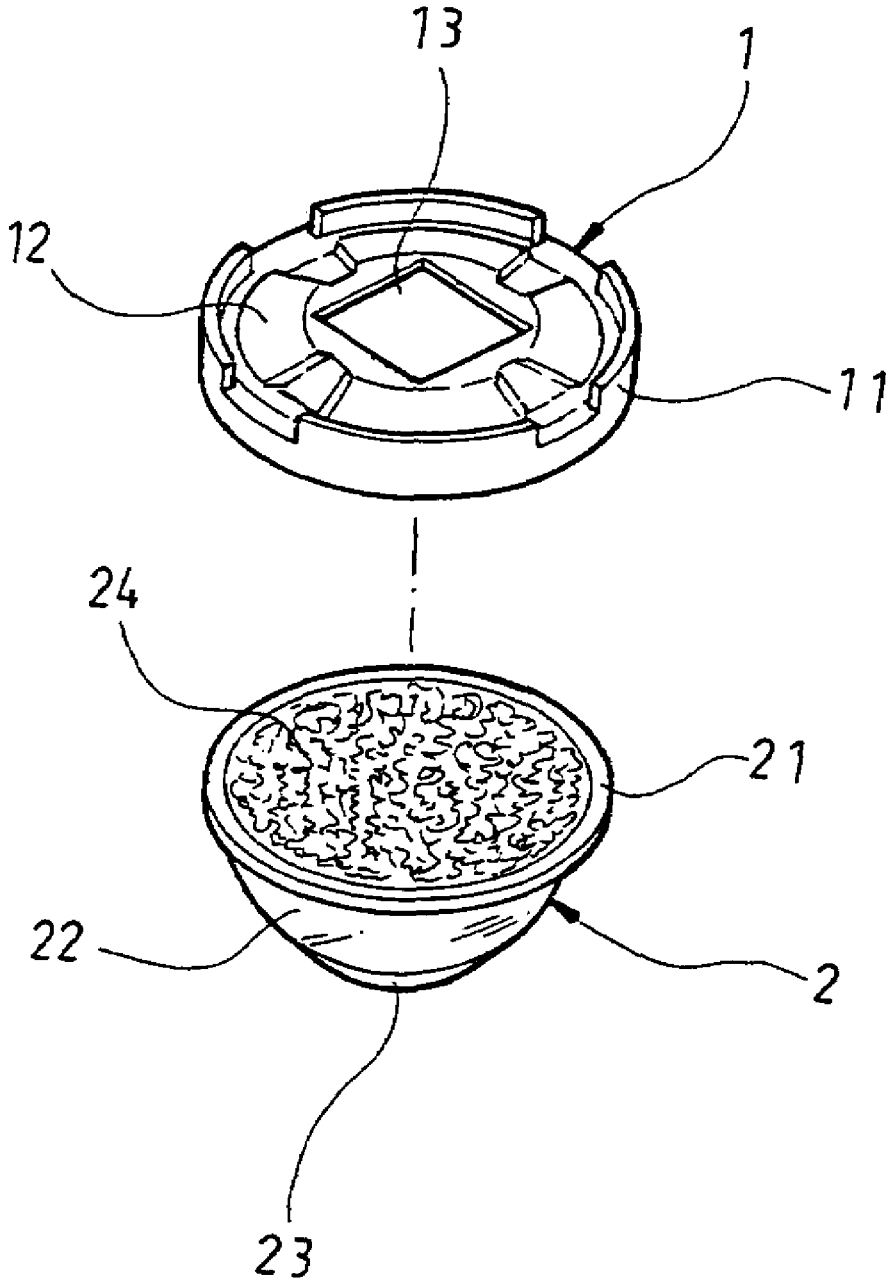
FIG. 2 is an exploded view of FIG. 1.

Please refer to FIGS. 1 and 2 that are assembled and exploded bottom perspective views, respectively, of a light source lens 100 according to a preferred embodiment of the present invention. As shown, the light source lens 100 of the present invention includes a circular lens mount 1 and a lens 2.

The circular lens mount 1 is provided along an outer periphery with an upright flange 11 having a predetermined height, so that a shallow concave recess 12 is defined on the annular lens mount 1 within the flange 11. A top surface of the shallow concave recess 12 is reflectorized, and a square opening 13 is formed at a center of the shallow concave recess 12 to allow a light source to project to the lens 2 via the square opening 13. The lens 2 is engaged with the lens mount 1 to locate above the shallow concave recess 12.

The lens 2 is provided around a bottom periphery with a radially extended flange 21 for firmly engaging with an inner side of the upright flange 11 on the lens mount 1. The lens 2 includes a first spherical portion 22 and a second spherical portion 23 slightly raised from a top center of the first spherical portion 22 by a predetermined distance, so that the first and the second spherical portion 22, 23 have different curvatures to provide two refraction areas to produce different refraction angles. A bottom of the lens 2 is densely provided with a plurality of irregularly arranged grooves 24 to form an uneven bottom surface.

The light source lens 100 may be applied on a light emitting diode (LED) lamp. To do so, simply assemble the light source lens 100 to the LED lamp to locate in front of an LED on the LED lamp. When the LED emits light, the light is diffused by the first spherical portion 22 of the lens 2 but concentrated by the second spherical portion 23. As a result, the lens 2 makes the light source from the LED more even to thereby form an illuminated area without any halo. The uneven and irregular grooves 24 densely provided at the bottom surface of the lens 2 have the function of increasing the scattering angle of the light source to create softer lighting effect.

Figure 3:
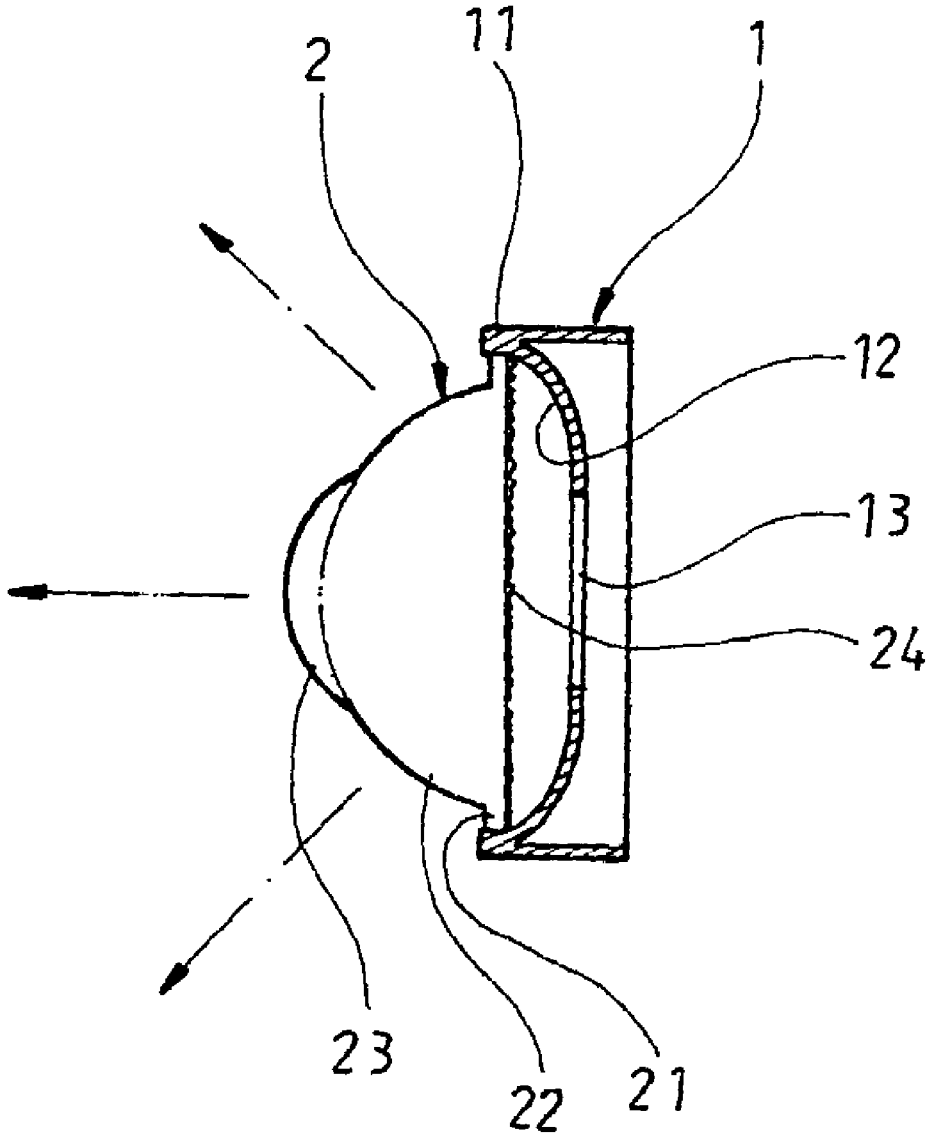
FIG. 3 is a sectioned side view of FIG. 1.

Please refer to FIG. 3. The lens 2 is firmly assembled to the lens mount 1 through engagement of the radially extended flange 21 with the upright flange 11. The lens 2 is horizontally located above the lens mount 1. Since the first and the second spherical portion 22, 23 have different curvatures to provide different refraction angles, a light source forward projected through the lens 2 via the bottom surface thereof is diffused by the first spherical portion 22 but concentrated by the second spherical portion 23. As a result, the light source passed through the lens 2 becomes more even without forming a halo around the illuminated area. With the uneven and irregular grooves 24 densely provided at the bottom surface of the lens 2, the light source may be scattered at more different angles and becomes softer without causing sore eyes and poor sight even a user has worked under the lamp over a long time.

Figure 4:
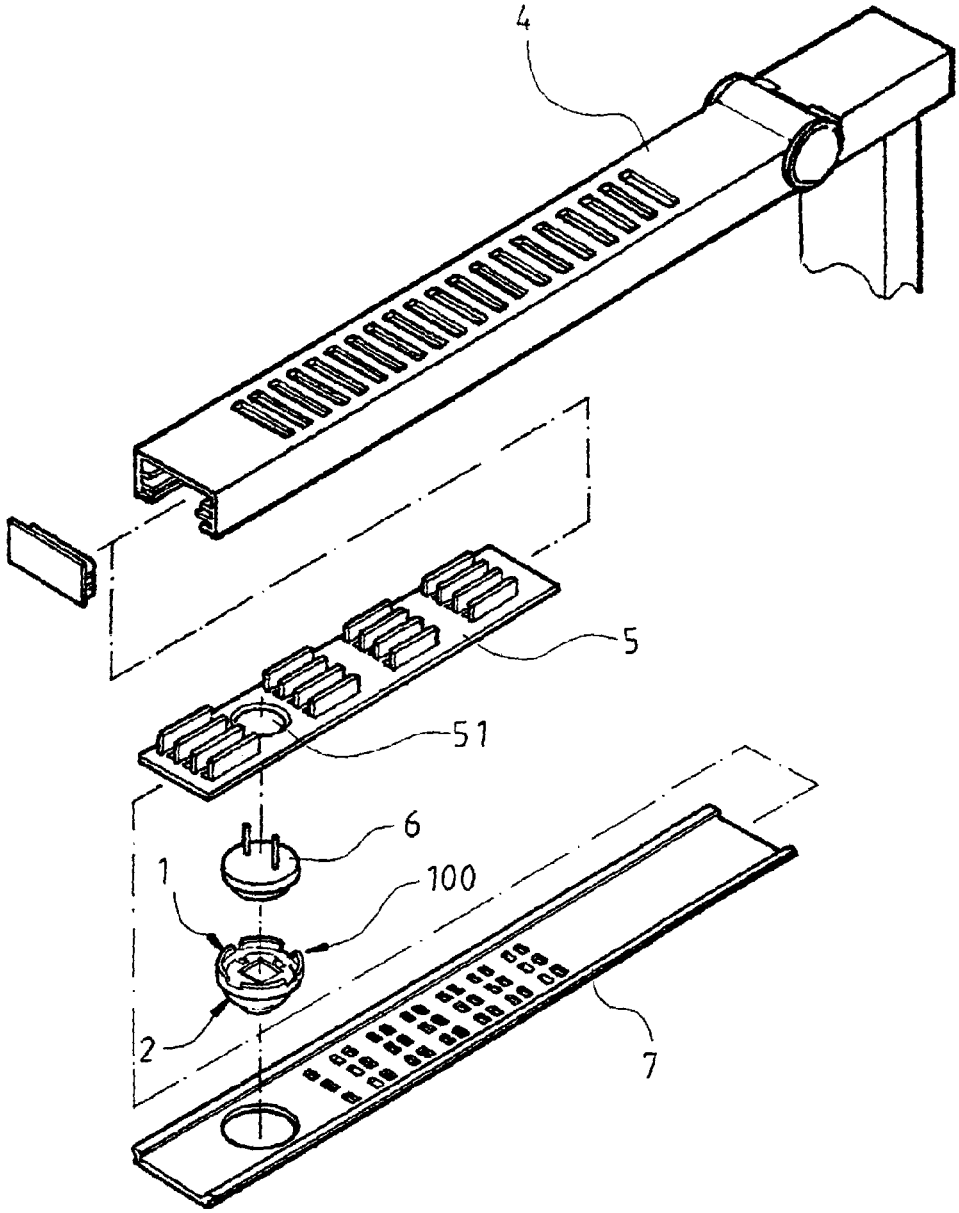
FIG. 4 is a fragmentary perspective view showing the assembling of the light source lens of the present invention to an LED lamp.
Figure 5:
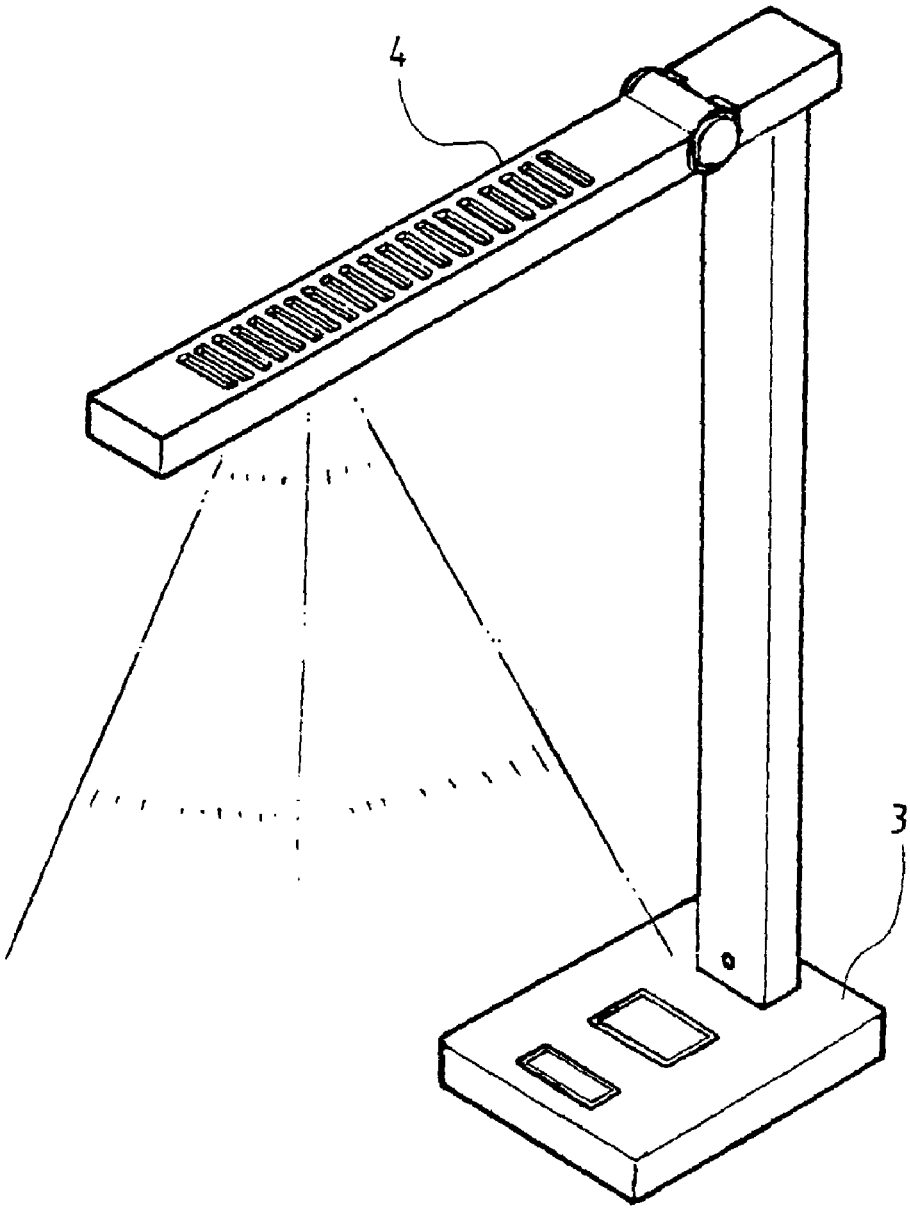
FIG. 5 is a perspective view showing the light source lens of the present invention has been assembled to an LED lamp.

Please refer to FIGS. 4 and 5 at the same time. The light source lens 100 of the present invention may be applied on an LED lamp. The LED lamp may include a base 3 and a pivotally turnable lamp holder 4 connected at an end to the base 3. The lamp holder 4 is internally provided with a heat sink 5, on which at least one mounting hole 51 is provided for at least one LED 6 to mount thereto. The light source lens 100 of the present invention is mounted on a bottom plate 7 of the lamp holder 4 to locate in front the LED 6. When the LED 6 is lighted to illuminate ambient environment, the light emitted from the LED 6 passes through the lens 2 and is refracted to become softer without forming a halo around the illuminated area. With the lens 2, the light from the LED 6 is scattered at more different angles to create an even softer lighting effect.

In brief, the present invention provides a-light source lens 100 that includes a lens 2 having two spherical portions 22, 23 with different curvatures, so that the light source lens 100 mounted in front of an LED 6 on an LED lamp is able to soften the light emitted from the LED 6 to avoid causing sore eyes and poor sight.

What is claimed is:

1. A light source lens comprising a circular lens mount, and a lens engaged with the lens mount;

the circular lens mount being provided along an outer periphery with an upright flange having a predetermined height, so that a shallow concave recess is defined on the annular lens mount within the flange; and the shallow concave recess being formed at a center with a square opening, via which a light source may be projected to the lens; and the lens including a first spherical portion and a second spherical portion slightly raised from a top center of the first spherical portion by a predetermined distance, so that the first and the second spherical portion have different curvatures to provide two refraction areas producing different refraction angles; and a bottom of the lens being densely provided with a plurality of irregularly arranged grooves to form an uneven bottom surface;

whereby when the light source lens is mounted on a light emitting diode (LED) lamp in front of an LED, light emitted from the LED and passed through the lens is diffused by the first spherical portion but concentrated by the second spherical portion to become more even without forming a halo around an illuminated area; and, with the uneven and irregular grooves densely provided at the bottom surface of the lens, the light from the LED may be scattered at more different angles to create softer lighting effect.

2. The light source lens as claimed in claim 1, wherein the lens is provided around a bottom periphery with a radially extended flange for firmly engaging with an inner side of the upright flange on the lens mount to thereby locate above the shallow concave recess.

* * * * *